United States Patent [19]

Meisenburg

[11] Patent Number: 4,950,190

[45] Date of Patent: Aug. 21, 1990

[54] MARINE STERN DRIVE UNIT WITH IMPROVED WATER HANDLING

[75] Inventor: Gary L. Meisenburg, Fond Du Lac, Wis.

[73] Assignee: Brunswick Corporation, Skokie, Ill.

[21] Appl. No.: 336,734

[22] Filed: Apr. 12, 1989

[51] Int. Cl.[5] ..... B63H 21/10

[52] U.S. Cl. ..... 440/88

[58] Field of Search ..... 440/88, 89, 75; 123/41.14; 60/321

[56] References Cited

U.S. PATENT DOCUMENTS

| | | | |
|---|---|---|---|
| 3,181,494 | 5/1965 | Kiekhaefer et al. | 440/89 |
| 3,182,629 | 5/1965 | Armantrout et al. | 440/88 |
| 4,699,598 | 10/1987 | Bland et al. | 440/88 |

*Primary Examiner*—Joseph F. Peters, Jr.

*Assistant Examiner*—Jesus D. Sotelo

*Attorney, Agent, or Firm*—Andrus, Sceales, Starke & Sawall

[57] ABSTRACT

A marine stern drive unit (1) includes a fluid passage disposed within a drive shaft housing (11) of cast construction. The fluid passage has a discharge outlet (23) which is connected to the lower inlet end (41) of a generally centrally disposed vertical water cavity (24) cored into the drive shaft housing casting. The connection is very simple between the outlet and inlet. In addition, the vertical water cavity (24) in the drive shaft housing casting (19) is connected to a horizontal water pocket (59) therein through an angular connector passage (67) which is formed in a manner so as to require drilling through only a single wall remote from the shift pocket. The angularities involved reduce the sharpness of fluid flow turns.

3 Claims, 4 Drawing Sheets

FIG. 1
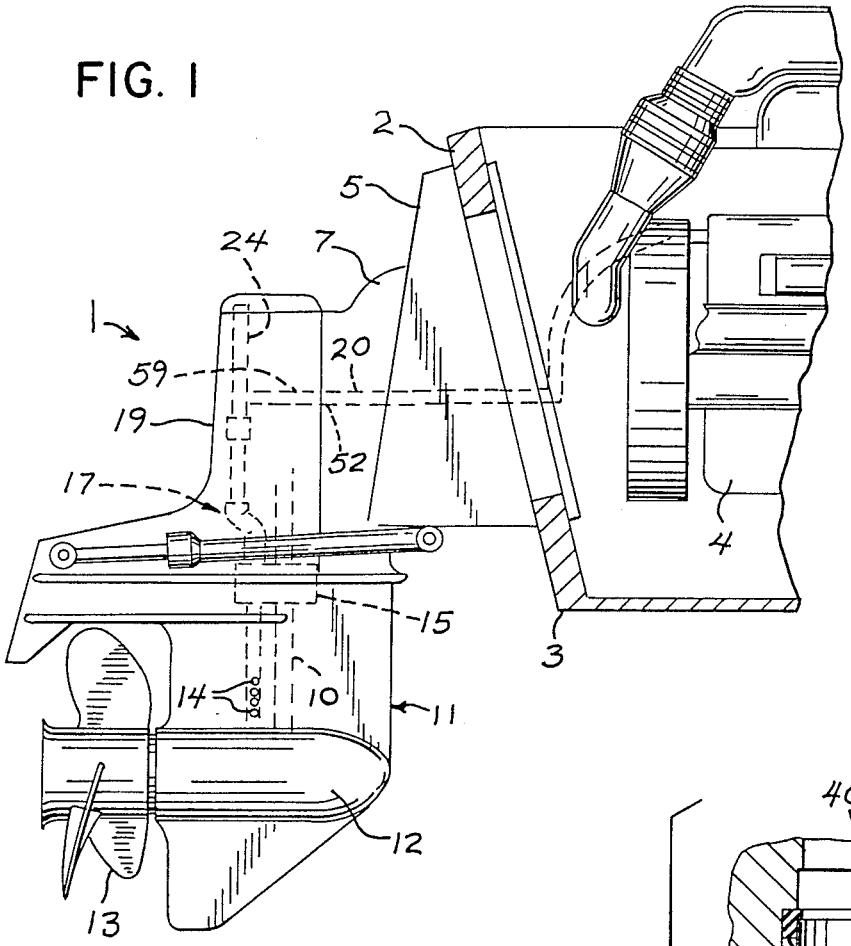
FIG. 4
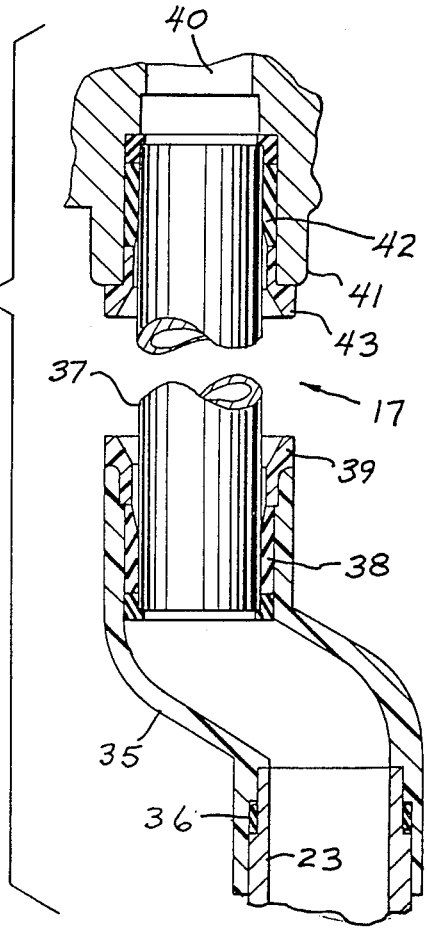
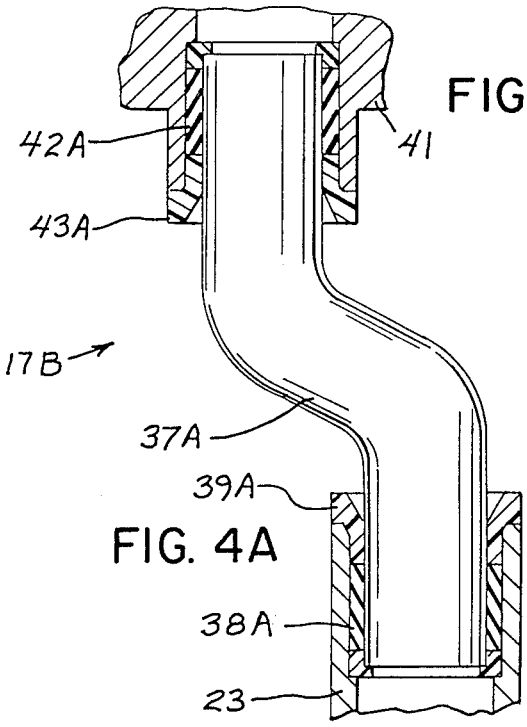
FIG. 4A

MARINE STERN DRIVE UNIT WITH IMPROVED WATER HANDLING

BACKGROUND AND SUMMARY OF THE INVENTION

This invention relates to marine stern drive units, and more particularly to the arrangement for supplying cooling water through the unit and to the inboard engine.

Prior known systems have utilized various constructions for providing a water flow connection from a water pump outlet and hence through the cast drive shaft housing and to the bell housing, which is subsequently fluidly connected to the drive engine. Such connections have normally been cumbersome and complex, and have required excessive machining of the cast parts during manufacture. The result has been relatively high production costs, as well as a tendency for undesirable leakage. Furthermore, the fluid flow path has been relatively tortuous, resulting in higher back pressures than desired.

For example, and in known constructions, numerous small parts have been utilized between the water pump outlet and the inlet at the lower end of the relatively large generally vertically extending cored water cavity in the drive shaft housing aft of the drive shaft axis. Gaskets, seals, a cover and many small fastening bolts have been used. These elements are buried within the unit and hard to gain access to for maintenance and repair.

As a further example, the said vertical water cavity in the drive shaft housing must fluidly connect to a generally horizontal cored fluid flow water pocket in the housing which matingly joins with a bell housing passage for fluid flow thereinto. In order to fluidly connect the water cavity and water, pocket in the cast drive shaft housing structure, it has been found necessary to drill through three walls in the casting to obtain the single fluid connection, and to then plug two of the walls, due to the presence of a generally horizontal shift pocket cast into the drive shaft housing and which runs generally parallel to the water pocket. In addition, this construction has required at least several very sharp turns of fluid flow, which is undesirable.

It is an object of the present invention to reduce the aforementioned problems to provide ease of machining and assembly of the drive, to eliminate the excess number of small parts and to enhance the fluid flow characteristics such as by essentially reducing back pressure in the drive unit.

In accordance with the various aspects of the invention, a marine stern drive unit includes a fluid passage disposed within a drive shaft housing of cast construction. The fluid passage has a discharge outlet which is connected to the lower inlet end of a generally centrally disposed vertical water cavity cored into the drive shaft housing casting. The connection is very simple between the outlet and inlet. In addition, the vertical water cavity in the drive shaft housing casting is connected to a horizontal water pocket therein through an angular connector passage which is formed in a manner so as to require drilling through only a single wall remote from the shift pocket. The angularities involved reduce the sharpness of fluid flow turns.

BRIEF DESCRIPTION OF THE DRAWINGS

The accompanying drawings furnished herewith illustrate the best mode presently contemplated by the inventor for the invention and are described hereinafter.

In the drawings:

FIG. 1 is a schematic side elevational view of a marine stern drive unit which incorporates various aspects of the invention;

FIG. 4 is an enlarged fragmentary generally sectional view of the connection between the water pump outlet of a first embodiment and the inlet to the vertical water cavity in the drive shaft housing casting, shown more generally in FIG. 2, illustrating one of the aspects of the present invention;

FIG. 4A is a view of a second embodiment of the connection;

DESCRIPTION OF THE PREFERRED EMBODIMENT

Figure 2:
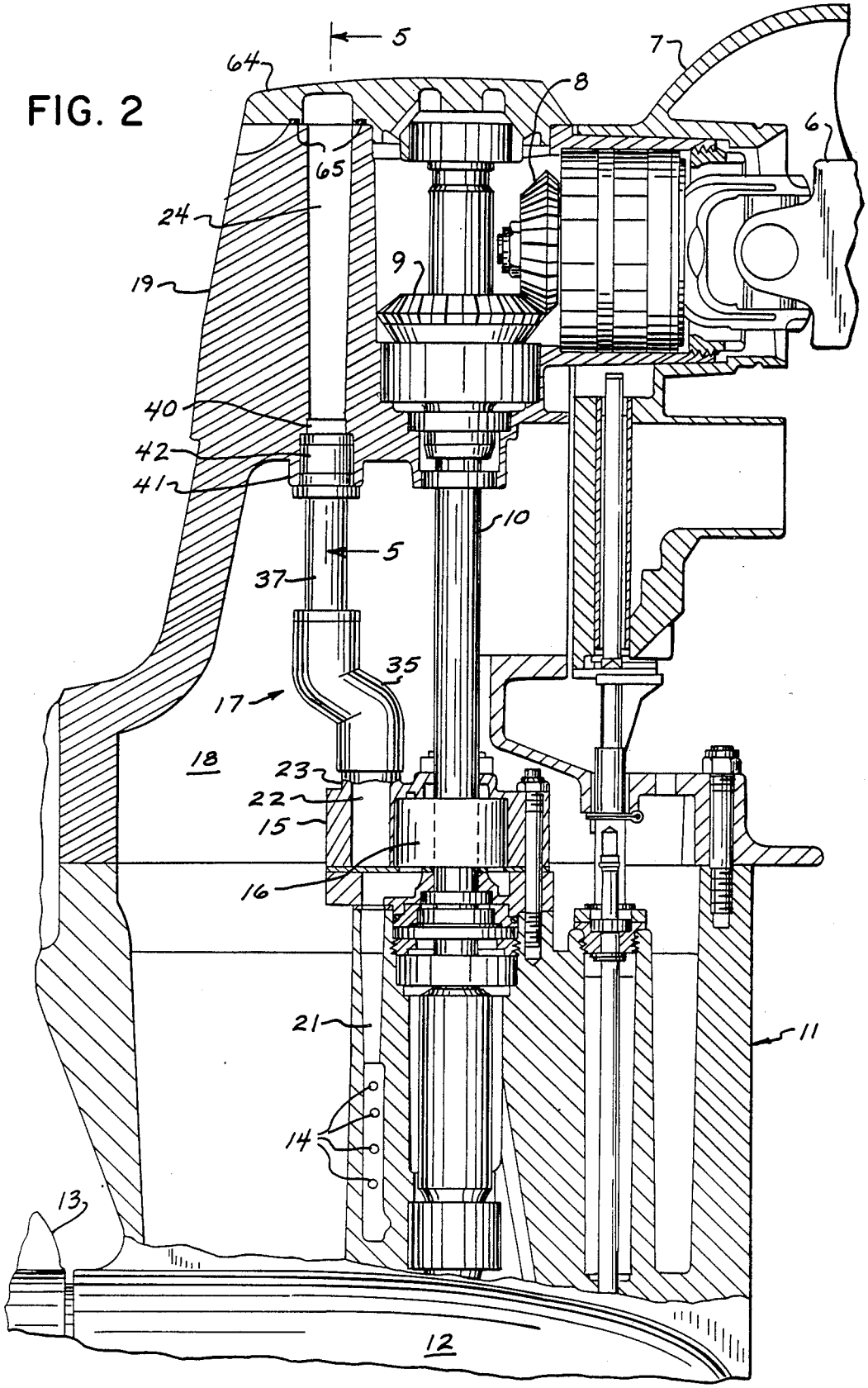
FIG. 2 is an enlarged vertical generally sectional view of the drive shaft housing, showing the generally conventional drive apparatus as well as portions of the aspects of the present invention.

As best shown in FIGS. 1 and 2 of the drawings, and in the present embodiment, the various aspects of the invention are utilized in a marine stern drive unit 1 adapted to be suitably mounted to the transom 2 of a boat 3. An internal combustion engine 4 is disposed inboard of the boat and has a drive output which connects through a gimbal housing 5 and a universal joint 6 in a bell housing 7 exteriorly of transom 2 to a pinion 8. Pinion 8 meshes with a gear 9 mounted to the upper end of a vertical main drive shaft 10, with shaft 10 extending downwardly through a gear case or drive shaft housing 11 to a torpedo housing 12 which mounts a propeller 13 connected to shaft 10 in the usual manner.

Housings 5, 7 and 11 are of cast construction.

Cooling water is provided to engine 4 from water intake ports 14 disposed on the side of the submerged portion of drive shaft housing 11. Generally, water passes from intake ports 14 and through a fluid passage to an outlet portion. In the present embodiment, the fluid passage is associated with a water pump 15 having an impeller 16 and mounted to drive shaft 10. The water flows hence upwardly through a manually assembleable quickly releasable conduit means 17 in the internal drive shaft housing chamber 18 to an upper drive shaft housing portion 19. The cooling water then passes through portion 19, as will be described more fully hereinafter, and into and through bell housing 7 and through a conduit 20 in gimbal housing 5 which passes through transom 2 to engine 4.

Referring to FIG. 2, intake ports 14 communicate through a vertical housing passage 21 and through pump 15 to a pump outlet chamber 22 terminating upwardly in an annular neck 23 in the water pump cover of the embodiment shown. In addition, upper drive shaft housing portion 19 is provided with a vertical water cavity 24, the lower end of which is fluidly connected to the aforesaid conduit means 17.

Heretofore, and in the prior art construction shown in FIG. 3, the lower end of the conduit means 17A was connected to a water pump outlet neck 23, and extended upwardly for fluid connection to the lower end of a vertical water cavity 25 disposed in a cast upper drive shaft housing portion 19A of somewhat different construction than that of portion 19, as will be described. In the known construction of FIG. 3, the conduit means 17A included numerous parts. As shown, inner and outer telescoping tubes 26 and 27 extended upwardly from neck 23, with an annular seal 28 disposed at the base of outer tube 27 in the neck. The upper end of inner tube 26 protruded upwardly beyond tube 27 and connected through to water cavity 25. For purposes of making the connection, a downwardly facing housing cap or cover 29 was secured to the lower end of drive shaft housing portion 19A at the lower terminus of cavity 25, as by a plurality of mounting bolts 30. Cover 29 formed a passage 31 connected to cavity 25 and extending downwardly where it terminated in a downwardly extending offset neck 32 which was aligned with pump neck 23. The upper end of inner tube 26 was disposed in neck 32 with a suitable annular seal 33 therebetween, for communication with passage 31. Furthermore, a gasket 34 was sandwiched between cover 29 and drive shaft housing portion 19A.

The resultant prior construction involved numerous small parts buried within the drive shaft housing, creating problems in assembly and access for repair in the event of leakage. In accordance with some aspects of the invention, these problems have been essentially reduced.

Figure 5:
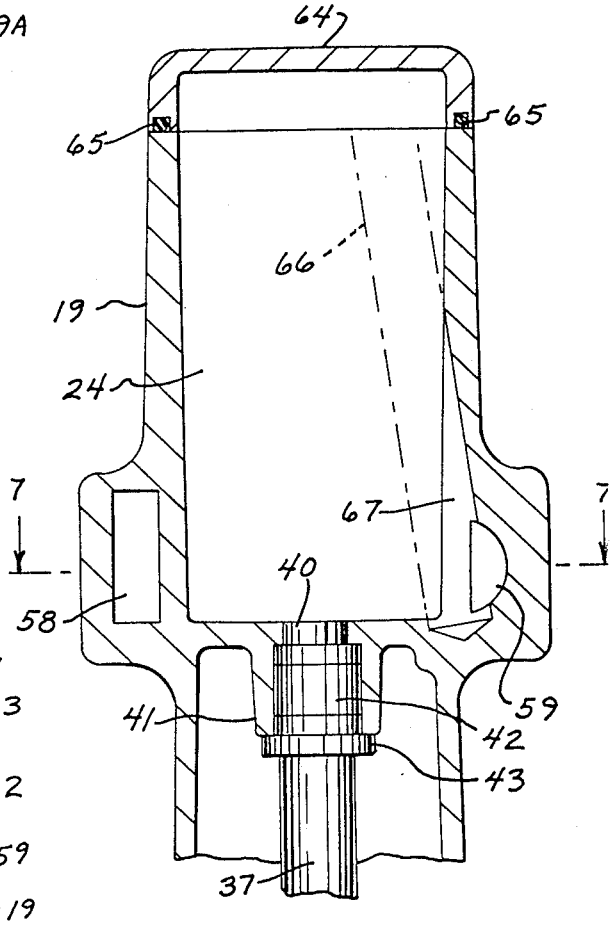
FIG. 5 is a generally sectional vertical view taken on line 5—5 of FIG. 2 and illustrating the water cavity portion of the drive shaft housing constructed in accordance with an aspect of the present invention.

Referring particularly to the embodiment of FIGS. 2, 4 and 5, the conduit means 17 includes an adapter tube 35 of preferably plastic material, with the lower end of tube 35 being removably fit over pump outlet neck 23 and sealed thereto, as by an O-ring 36.

It should be noted that, in a broad sense, neck 23 forms the outlet portion of the fluid passage communicating with intake ports 14.

Tube 35 curves upwardly within chamber 18 and is removably fit over the lower end portion of a generally vertical connector tube 37 of suitable material, and sealed thereto, as by an annular seal means 38 of neoprene or the like. A lower annular tube guide 39, which also acts as a seal retainer, surrounds tube 37 and is removably fit over the upper terminus of adapter tube 35.

Connector tube 37 extends upwardly to adjacent the lower terminus of drive shaft housing water cavity 24. In this instance, a cored (not machined) hole 40 is disposed centrally in the lower housing wall and communicates between cavity 24 and a downwardly extending annular neck 41 in chamber 18 and cast into housing portion 19. The upper end of connector tube 37 is removably fit into neck 41 and sealed thereto, as by an annular seal means 42. An upper annular tube guide 43, which also acts as a seal retainer, surrounds tube 37 and is removably fit over the lower terminus of neck 41.

The construction described is relatively inexpensive and simple, and the parts of the connection are easily and quickly assembled and also disassembled in a quick release manner without the need for special tools, as contrasted with known prior devices.

FIG. 4A illustrates a second embodiment of conduit means 17B which eliminates the need for adapter tube 35 and O-ring 36. In this second embodiment, a connector tube 37A, preferably made of copper and having offset radius bends, is directly connected between an outlet neck 23 and housing inlet portion 41. In this instance, neck 23 is modified to accept a seal 38A and tube guide 39A directly at the lower end of tube 37A. The upper end of tube 37A co-engages with seal 42A and tube guide 43A.

As generally described previously, and in the present embodiment, water passes through pump 15 and upwardly through the conduit means 17 to and through upper drive shaft housing portion 19, and hence through bell housing 7 and conduit 20 to engine 4.

Figure 3:
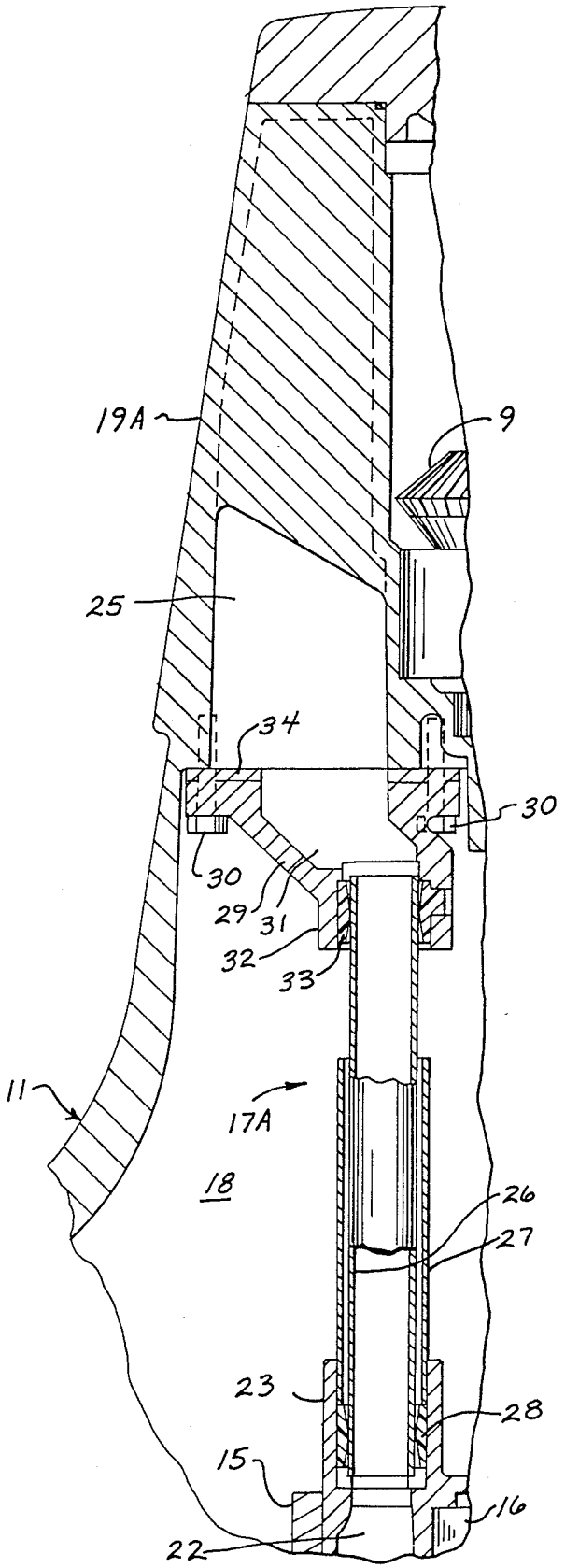
FIG. 3 PRIOR ART
FIG. 3 is an enlarged fragmentary generally sectional view, somewhat similar to FIG. 2, of a known prior construction.
Figure 6:
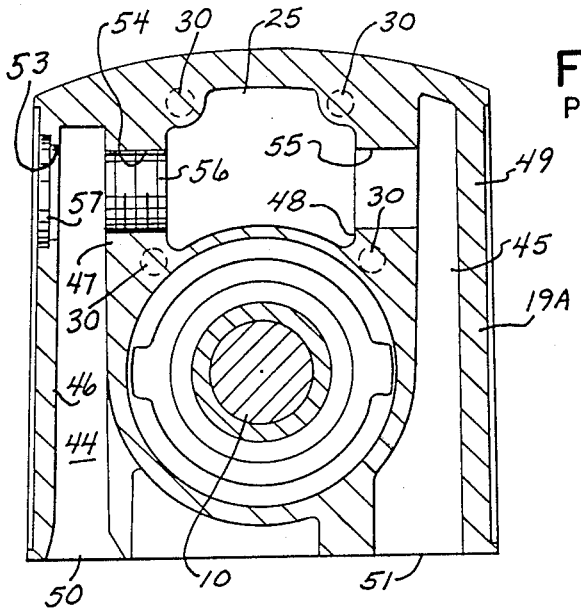
FIG. 6 PRIOR ART
FIG. 6 is a downwardly facing horizontal sectional showing of a previously known construction of the water cavity portion of the drive shaft housing.

Referring to the pass-through in the upper drive shaft housing portion, and referring to prior art in FIGS. 3 and 6, the known upper drive shaft housing portion 19A included the previously mentioned generally square vertically extending water cavity 25 which was connected to the conduit means 17A. As best seen in FIG. 6, which is a generally horizontal sectional view, housing portion 19A also included a pair of generally parallel horizontal pockets, designated as shift pocket 44 and water pocket 45, disposed on opposite sides of main drive shaft 10. Pockets 44 and 45, as well as cavity 25, were formed as cored portions in portion 19A when the latter was cast. During casting of portion 19A, four continuous walls were formed: external left side wall 46, internal left wall 47 disposed along the aft side of water cavity 25, internal right wall 48 disposed along the front side of water cavity 25, and finally external right side wall 49. Shift pocket 44 extended between and was at least partially delineated by walls 46 and 47, while water pocket 45 extended between and was at least partially delineated by walls 48 and 49.

When the drive was assembled, the outer end 50 of shift pocket 44 opened into bell housing 7 and contained an aluminum casting (not shown) which assisted in changing gears. Likewise, the outer terminus end 51 of water pocket 45 mated with a bell housing passage, as at 52 in FIG. 1, which communicated with conduit 20 in gimbal housing 5.

It is essential that the vertical water cavity 25 fluidly connects to water pocket 45. However, in the casting procedure in forming known housing portion 19A, wall 48 was of necessity formed as continuous, and there was no suitable connection. In order to solve the problem, the manufacturing process previously utilized drilling inwardly through walls 46 and 47, which then provided access for drilling through wall 48 to connect cavity 25 to water pocket 45. Thus, three walls had to be drilled through to create one connection. The drilled openings were: hole 53 in wall 46, hole 54 in wall 47, and finally hole 55 in wall 48.

In the known construction of FIG. 6, only hole 55 was actually needed. Furthermore, holes 53 and 54 were undesirable because their presence would subject shift pocket 44 to water, either from outside housing portion 19A through hole 53, or from water cavity 25 through hole 54. Thus, it has been found necessary to close holes 53 and 54. For this purpose, hole 54 in left internal wall 47 had to be machined to provide suitable threads for receiving a threaded plug 56 therein. Furthermore, hole 53 had to be suitably machined to provide a counterbore for press-fittingly receiving a welch plug 57 therein.

The resultant prior construction has been found to be expensive and wasteful to manufacture. Furthermore, the water flow path had several sharp turns of about 90°. That is: upwardly through water cavity 25, with a sharp horizontal turn into hole 55, and then a further sharp horizontal turn into water pocket 45. In accordance with further aspects of the invention, these problems have been essentialy reduced.

Figure 7:
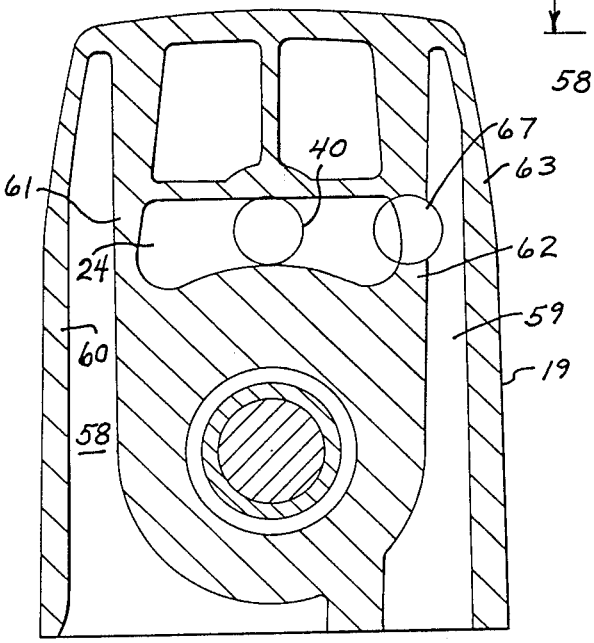
FIG. 7 is a horizontal section taken on line 7—7 of FIG. 5 of the water cavity portion of the drive shaft housing constructed in accordance with an aspect of the present invention.

Referring particularly to FIGS. 2, 5 and 7, water cavity 24 in drive shaft housing portion 19 extends upwardly from cored central inlet hole 40. Cavity 24 is shown as being generally sunglass shaped in section, which brings cooling water closer to main drive shaft 10 and its mountings. In the casting of housing portion 19 there are formed, somewhat similarly to known housing portion 19A, a pair of generally horizontal parallel cored pockets, designated as shift pocket 58 and water pocket 59, which have the same function as respective pockets 44 and 45 of FIG. 6. Likewise, the casting process creates walls generally similar to those in housing portion 19A, thusly: left side wall 60, left internal wall 61, right internal wall 62, and finally right side wall 63.

A separate cover 64 for the upper end of water cavity 24 is mounted to the top of drive shaft housing portion 19. Suitable seals 65 are provided between cover 64 and housing portion 19.

Instead of drilling horizontally through three cast walls as in 46–48 of FIG. 6, it is now contemplated that a single drilling is made, the path of which is illustrated in phantom at 66 in FIG. 5. Before attaching cover 64, by drilling angularly downwardly and outwardly along the vertical extent of housing portion 19, a breakthrough passage 67 is created between cavity 24 and water pocket 59 to provide the required connection therebetween. Thus, only a single drilling step is required. In this procedure, walls 60 and 61 remain untouched and continuous, and there is no need for machining unnecessary holes and then plugging them.

The construction, again, is relatively inexpensive and simple to manufacture and maintain as compared to known devices, with less chance for leakage. Furthermore, the water flow path within drive shaft housing portion 19 has turns of less sharpness than previously, that is, less than 90°. The result is to lower the back pressure in the drive unit.

Various modes of carrying out the invention are contemplated as being within the scope of the following claims, which particularly point out and distinctly claim the subject matter of the invention.

I claim:

1. A marine stern drive unit (1) for connection to an inboard marine engine (4), comprising, in combination:

(a) a generally vertically extending cast main drive shaft housing (11) having a water cavity (24) extending upwardly therethrough and with said cavity having a lower inlet portion (41) cast into an upper portion (19) of said housing, (b) water intake means (14) disposed in a lower underwater portion of said housing, (c) means fluidly connecting said water intake means (14) to said inlet portion (41) of said water cavity (24), (d) said upper portion (19) of said cast drive shaft housing (11) including:

(1) a generally horizontal cored shift pocket (58) delineated in part by a continuous first housing side wall (60) and a continuous first housing internal wall (61) adjacent said water cavity (24), (2) a generally horizontal cored water pocket (59) adapted for fluid connection to the said engine, and with said water pocket being delineated in part by a continuous second housing side wall (63) and a second housing internal wall (62) adjacent said water cavity, (e) cover means (64) sealingly attached to the upper end of said upper housing portion and with said cover means including an upper end portion of said water cavity (24), (f) and a drilled breakthrough passage (66,67) disposed in said second housing internal wall (62) and with said breakthrough passage fluidly connecting the said upper end portion of said water cavity in said cover means to said water pocket (59).

2. The combination of claim 1 in which said breakthrough passage (66,67) extends generally vertically and is inclined angularly outwardly in a downward direction.

3. The combination of claim 1 or 2 wherein the construction is such that said cover means (64), when unattached to said upper housing portion, permits drilling of said breakthrough passage (66,67) in said upper housing portion.

* * * * *